US009597551B2

(12) United States Patent
Bartels

(10) Patent No.: US 9,597,551 B2
(45) **Date of Patent: *Mar. 21, 2017**

(54) GOLF BALL

(71) Applicant: Callaway Golf Company, Carlsbad, CA (US)

(72) Inventor: David Bartels, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/249,101

(22) Filed: Aug. 26, 2016

(65) Prior Publication Data

US 2016/0367863 A1 Dec. 22, 2016

Related U.S. Application Data

(63) Continuation of application No. 15/070,744, filed on Mar. 15, 2016, which is a continuation of application No. 14/933,993, filed on Nov. 5, 2015, now Pat. No. 9,320,943, which is a continuation of application No. 14/844,945, filed on Sep. 3, 2015, now Pat. No. 9,278,260.

(60) Provisional application No. 62/149,367, filed on Apr. 17, 2015.

(51) Int. Cl.
*A63B 37/06* (2006.01)
*A63B 37/00* (2006.01)

(52) U.S. Cl.
CPC ..... *A63B 37/0087* (2013.01); *A63B 37/008* (2013.01); *A63B 37/009* (2013.01); *A63B 37/0031* (2013.01); *A63B 37/0033* (2013.01); *A63B 37/0035* (2013.01); *A63B 37/0043* (2013.01); *A63B 37/0045* (2013.01); *A63B 37/0051* (2013.01); *A63B 37/0054* (2013.01); *A63B 37/0061* (2013.01); *A63B 37/0064* (2013.01); *A63B 37/0065* (2013.01); *A63B 37/0066* (2013.01); *A63B 37/0067* (2013.01); *A63B 37/0075* (2013.01); *A63B 37/0076* (2013.01); *A63B 37/0077* (2013.01); *A63B 37/0078* (2013.01); *A63B 37/0083* (2013.01); *A63B 37/0089* (2013.01); *A63B 37/0091* (2013.01); *A63B 37/0096* (2013.01); *A63B 2037/0079* (2013.01)

(58) Field of Classification Search
CPC ..... A63B 37/0075
USPC ..... 473/373, 374
See application file for complete search history.

(56) References Cited

U.S. PATENT DOCUMENTS 9,278,260 B1 * 3/2016 Bartels ..... A63B 37/0087
9,320,943 B1 * 4/2016 Bartels ..... A63B 37/0087

* cited by examiner

*Primary Examiner* — Raeann Gorden
(74) *Attorney, Agent, or Firm* — Michael A. Catania; Sonia Lari; Rebecca Hanovice

(57) ABSTRACT

An ultra-low compression golf ball is disclosed herein. The core preferably has a PGA compression less than 30. The mantle layer and cover have approximately the same thickness. The cover comprises a thermoplastic polyurethane material and has a specific gravity greater than the core and mantle layer. The golf ball has a PGA compression less than 75 and a COR of at least 0.780.

10 Claims, 12 Drawing Sheets

1011

1012

1015

1016

GOLF BALL

CROSS REFERENCES TO RELATED APPLICATIONS

The Present Application is a continuation application of U.S. patent application Ser. No. 15/070,744, filed on Mar. 15, 2016, which is a is a continuation application of U.S. patent application Ser. No. 14/933,993, filed on Nov. 5, 2015, now U.S. Pat. No. 9,320,943, issued on Apr. 26, 2016, which is a continuation application of U.S. patent application Ser. No. 14/844945, filed on Sep. 3, 2015, now U.S. Pat. No. 9,278,260, issued on Mar. 8, 2016, which claims priority to U.S. Provisional Patent Application No. 62/149367 filed on Apr. 17, 2015, now expired, all of which are hereby incorporated by reference in their entireties.

STATEMENT REGARDING FEDERALLY SPONSORED RESEARCH OR DEVELOPMENT

Not Applicable

BACKGROUND OF THE INVENTION

Field of the Invention

The present invention relates to low compression three-piece golf balls.

Description of the Related Art

The prior art discloses golf balls with low compressions.

Sullivan et al., U.S. Pat. No. 4,911,451, for a Golf Ball Cover Of Neutralized Poly(ethylene-acrylic acid)Copolymer, discloses in Table One a golf ball having a compression of below 50 and a cover composed of ionomers having various Shore D hardness values ranging from 50 to 61.

Sullivan, U.S. Pat. No. 4,986,545, for a Golf Ball discloses a golf ball having a Rhiele compression below 50 and a cover having Shore C values as low as 82.

Egashira et al., U.S. Pat. No. 5,252,652, for a Solid Golf Ball, discloses the use of a zinc pentachlorothiophenol in a core of a golf ball.

Pasqua, U.S. Pat. No. 5,721,304, for a Golf Ball Composition, discloses a golf ball with a core having a low compression and the core comprising calcium oxide.

Sullivan, et al., U.S. Pat. No. 5,588,924, for a Golf Ball discloses a golf ball having a PGA compression below 70 and a COR ranging from 0.780 to 0.825.

Sullivan et al., U.S. Pat. No. 6,142,886, for a Golf Ball And Method Of Manufacture discloses a golf ball having a PGA compression below 70, a cover Shore D hardness of 57, and a COR as high as 0.794.

Tzivanis et al., U.S. Pat. No. 6,520,870, for a Golf Ball, discloses a golf ball having a core compression less than 50, a cover Shore D hardness of 55 or less, and a COR greater than 0.80.

The prior art fails to disclose a three-piece golf ball with a low compression and a high COR for tour level performance.

BRIEF SUMMARY OF THE INVENTION

The present invention provides a three-piece golf ball with an ultra-low compression and a high COR for tour level performance.

One aspect of the present invention is an ultra-low compression golf ball consisting essentially of a core, mantle layer and a cover. The core comprises a lanthanide catalyzed polybutadiene and neodymium catalyzed polybutadiene having a Mooney viscosity of at least 60. The core has a diameter ranging from 1.50 inches to 1.60 inches. The core has a COR of at least 0.780. The mantle layer is disposed over the core, and composed of a blend of ionomers. The mantle layer has a thickness ranging from 0.025 inch to 0.040 inch. The mantle layer has a Shore D hardness of at least 60. The cover is disposed over the mantle layer. The cover is composed of a thermoplastic polyurethane material having a Shore A hardness ranging from 70 to 95, and a thickness ranging from 0.025 inch to 0.040 inch. The cover has a specific gravity greater than the core. The golf ball has a PGA compression no greater than 75. The golf ball has a COR greater than or equal to the COR of the core.

Another aspect of the present invention is an ultra-low compression golf ball consisting essentially of a core, mantle layer and a cover, with the core having a PGA compression no more than 30. The core comprises a lanthanide catalyzed polybutadiene and neodymium catalyzed polybutadiene having a Mooney viscosity of at least 60. The core has a diameter ranging from 1.50 inches to 1.60 inches. The core has a COR of at least 0.780. The core has a PGA compression less than 30. The mantle layer is disposed over the core, and composed of a blend of ionomers. The mantle layer has a thickness ranging from 0.030 inch to 0.037 inch. The mantle layer has a Shore D hardness ranging from 60 to 67. The cover is disposed over the mantle layer. The cover is composed of a thermoplastic polyurethane material having a Shore D hardness ranging from 30 to 36, and a thickness ranging from 0.030 inch to 0.036 inch. The cover has a specific gravity greater than the core. The mantle layer is no more than 0.002 inch thicker than the cover. The golf ball has a PGA compression no greater than 75. The golf ball has a COR greater than or equal to the COR of the core. The golf ball has a diameter ranging from 1.68 inches to 1.72 inches.

Yet another aspect of the present invention is an ultra-low compression golf ball consisting essentially of a core, mantle layer and a cover, with the core having a PGA compression no more than 30. The core comprises a lanthanide catalyzed polybutadiene and neodymium catalyzed polybutadiene having a Mooney viscosity of at least 60. The core has a diameter ranging from 1.50 inches to 1.60 inches. The core has a COR of at least 0.780. The core has a PGA compression less than 30. The core has a mass ranging from 32 grams to 38 grams. The mantle layer is disposed over the core, and composed of a blend of ionomers. The mantle layer has a thickness ranging from 0.030 inch to 0.037 inch. The mantle layer has a Shore D hardness ranging from 60 to 67. The mantle layer has a mass ranging from 3 grams to 5 grams. The cover is disposed over the mantle layer. The cover is composed of a thermoplastic polyurethane material having a Shore D hardness ranging from 30 to 36, and a thickness ranging from 0.030 inch to 0.036 inch. The cover has a mass ranging from 4.5 grams to 5.5 grams. The cover has a specific gravity greater than the core. The mantle layer is no more than 0.002 inch thicker than the cover. The golf ball has a PGA compression no greater than 75. The golf ball has a COR greater than or equal to the COR of the core. The golf ball has a diameter ranging from 1.68 inches to 1.72 inches.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
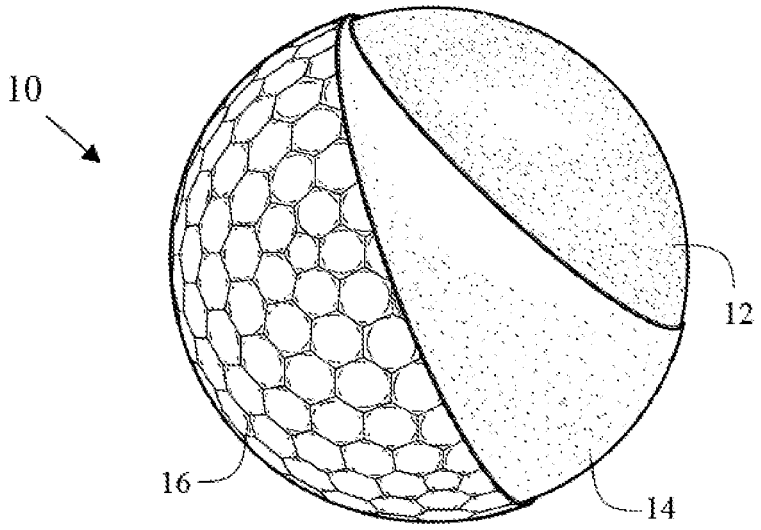
FIG. 1 is a partial cut-away view of a low compression three-piece golf ball.
Figure 2:
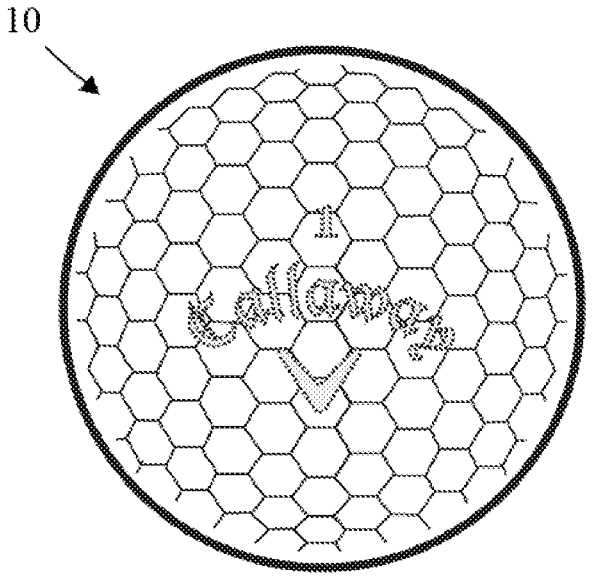
FIG. 2 is top perspective view of a low compression three-piece golf ball.

FIGS. 1 and 2 illustrate a low compression three-piece golf ball 10 comprising a core 12, a mantle 14 and a cover 16.

In a preferred embodiment, the cover is preferably composed of a thermoplastic polyurethane material, and preferably has a thickness ranging from 0.025 inch to 0.04 inch, and more preferably ranging from 0.03 inch to 0.04 inch. The material of the cover preferably has a Shore D plaque hardness ranging from 30 to 40, and more preferably from 32 to 36. The Shore D hardness measured on the cover is preferably less than 40 Shore D. Preferably the cover 16 has a Shore A hardness of less than 88. One example is disclosed in U.S. Pat. No. 7,367,903 for a Golf Ball, which is hereby incorporated by reference in its entirety. Another example is Melanson, U.S. Pat. No. 7,641,841, which is hereby incorporated by reference in its entirety. Another example is Melanson et al, U.S. Pat. No. 7,842,211, which is hereby incorporated by reference in its entirety. Another example is Matroni et al., U.S. Pat. No. 7,867,111, which is hereby incorporated by reference in its entirety. Another example is Dewanjee et al., U.S. Pat. No. 7,785,522, which is hereby incorporated by reference in its entirety.

The mantle layer 14 preferably has a thickness ranging from 0.02 inch to 0.04 inch, and more preferably from 0.030 inch to 0.038 inch. The mantle layer 14 is preferably composed of a blend of ionomer materials. One preferred embodiment comprises SURLYN 9150 material, SURLYN 8940 material, a SURLYN AD1022 material, and a masterbatch. The SURLYN 9150 material is preferably present in an amount ranging from 20 to 45 weight percent of the cover, and more preferably 30 to 40 weight percent. The SURLYN 8945 is preferably present in an amount ranging from 15 to 35 weight percent of the cover, more preferably 20 to 30 weight percent, and most preferably 26 weight percent. The SURLYN 9945 is preferably present in an amount ranging from 30 to 50 weight percent of the cover, more preferably 35 to 45 weight percent, and most preferably 41 weight percent. The SURLYN 8940 is preferably present in an amount ranging from 5 to 15 weight percent of the cover, more preferably 7 to 12 weight percent, and most preferably 10 weight percent.

SURLYN 8320, from DuPont, is a very-low modulus ethylene/methacrylic acid copolymer with partial neutralization of the acid groups with sodium ions. SURLYN 8945, also from DuPont, is a high acid ethylene/methacrylic acid copolymer with partial neutralization of the acid groups with sodium ions. SURLYN 9945, also from DuPont, is a high acid ethylene/methacrylic acid copolymer with partial neutralization of the acid groups with zinc ions. SURLYN 8940, also from DuPont, is an ethylene/methacrylic acid copolymer with partial neutralization of the acid groups with sodium ions.

The inner mantle layer is preferably composed of a blend of ionomers, preferably comprising a terpolymer and at least two high acid (greater than 18 weight percent) ionomers neutralized with sodium, zinc, magnesium, or other metal ions.

The material for the mantle layer preferably has a Shore D plaque hardness ranging preferably from 55 to 75, more preferably from 60 to 70, a most preferably approximately 65.

The mass of an insert including the core 12 and the mantle layer 14 preferably ranges from 38 grams to 42 grams, more preferably from 39 to 41 grams, and is most preferably approximately 40.5 grams.

Preferably the core 12 has a diameter ranging from 1.50 inches to 1.60 inches, more preferably from 1.52 inches to 1.58 inches, and most preferably approximately 1.54 inches. Preferably the core 12 has a PGA compression of less 30, more preferably less than 26, and most preferably less than 20. Preferably the core 12 is formed from a lanthanide catalyzed polybutadiene and neodymium catalyzed polybutadiene having a Mooney viscosity of at least 60, zinc diacrylate, zinc oxide, zinc stearate, a peptizer and peroxide.

Preferably the core 12 has a mass ranging from 30 grams to 40 grams, 32 grams to 38 grams and most preferably approximately 36 grams.

Preferably the core 12 has a deflection of at least 0.230 inch under a load of 220 pounds. Further, a compressive deformation from a beginning load of 10 kilograms to an ending load of 130 kilograms for the core 12 preferably ranges from 4 millimeters to 7 millimeters and more preferably from 5 millimeters to 6.5 millimeters. The ultra-low compression core allows for low spin off the tee to provide greater distance.

Figure 3:
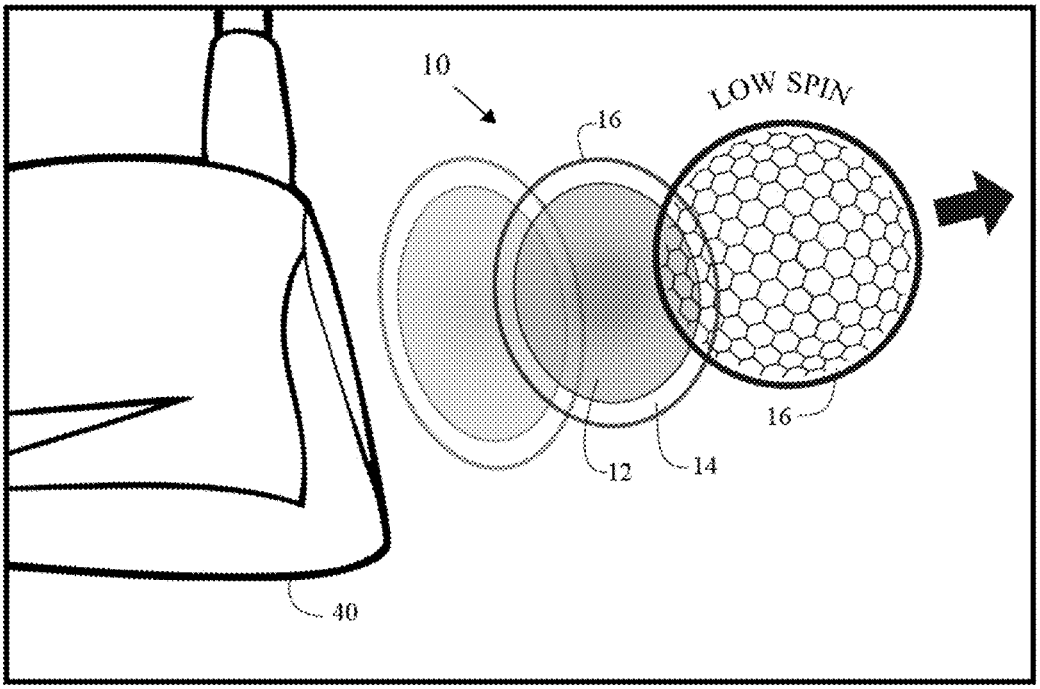
FIG. 3 is an illustration of a driver striking a low compression three-piece golf ball.

As shown in FIG. 3, the golf ball 10 has a low spin off a driver 40 for maximum ball speed and maximum distance with the core 12. The core 12 is the key to long, straight distance off the tee. and the preferably use of an optimized HEX AERODYNAMICS™ makes the golf ball 10 even longer by reducing drag and increasing lift.

Figure 4:
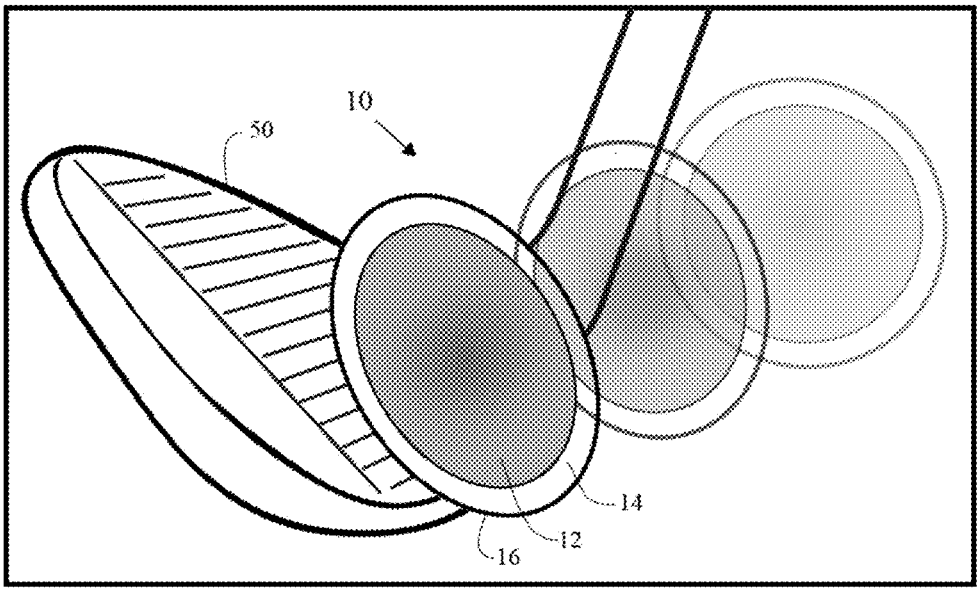
FIG. 4 is an illustration of a iron striking a low compression three-piece golf ball.

As shown in FIG. 4, the golf ball 10 provides a high level of control for aggressive shots off of an iron 50 due to the soft feel of the golf ball 10 and the thermoplastic polyurethane cover 16.

The golf ball 10 has a low compression thereby providing a soft feel to a golfer. The low 65 compression lets you compress the ball on iron shots for incredibly soft feel, and it's amazing around the greens. Now, all golfers can compress the ball like a professional tour player.

The golf ball 10 preferably has a diameter of at least 1.68 inches, a mass ranging from 44 grams to 47 grams, and more preferably from 45 grams to 46 grams, a COR of at least 0.780, and a PGA compression of no greater than 75, and more preferably a PGA compression of less than 65.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety.

Various aspects of the present invention golf balls have been described in terms of certain tests or measuring procedures. These are described in greater detail as follows.

As used herein, "Shore D hardness" of the golf ball layers is measured generally in accordance with ASTM D-2240 type D, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore D hardness of the cover is measured while the cover remains over the mantles and cores. When a hardness measurement is made on the golf ball, the Shore D hardness is preferably measured at a land area of the cover.

As used herein, "Shore A hardness" of a cover is measured generally in accordance with ASTM D-2240 type A, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore A hardness of the cover is measured while the cover remains over the mantles and cores. When a hardness measurement is made on the golf ball, Shore A hardness is preferably measured at a land area of the cover The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head speed, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the COR and the surface configuration of the ball.

The coefficient of restitution is the ratio of the outgoing velocity to the incoming velocity. In the examples of this application, the coefficient of restitution of a golf ball was measured by propelling a ball horizontally at a speed of 125±5 feet per second (fps) and corrected to 125 fps against a generally vertical, hard, flat steel plate and measuring the ball's incoming and outgoing velocity electronically. Speeds were measured with a pair of ballistic screens, which provide a timing pulse when an object passes through them. The screens were separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

PGA Compression as used herein is generated from an Instron machine which has a 200 pound load placed on the component (core, golf ball, or the like). The Instron deflection value is multiplied by 1000, and then this value is subtracted from 180 to generate the PGA compression value. For example, a most preferred Instron value for a golf ball 10 after seven days is 0.113. This value is multiple by 1000 to give a value of 113. Then, the PGA compression value is obtained by subtracting 180 from 113 to obtain a PGA compression value of 67. Likewise for the core 12, a most preferred Instron value after two days is 0.154. This value is multiple by 1000 to give a value of 154. Then, the PGA compression value is obtained by subtracting 180 from 154 to obtain a PGA compression value of 26.

The measurements for deflection, compression, hardness, and the like are preferably performed on a finished golf ball. The core is preferably measured within the two days of molding.

Figure 6:
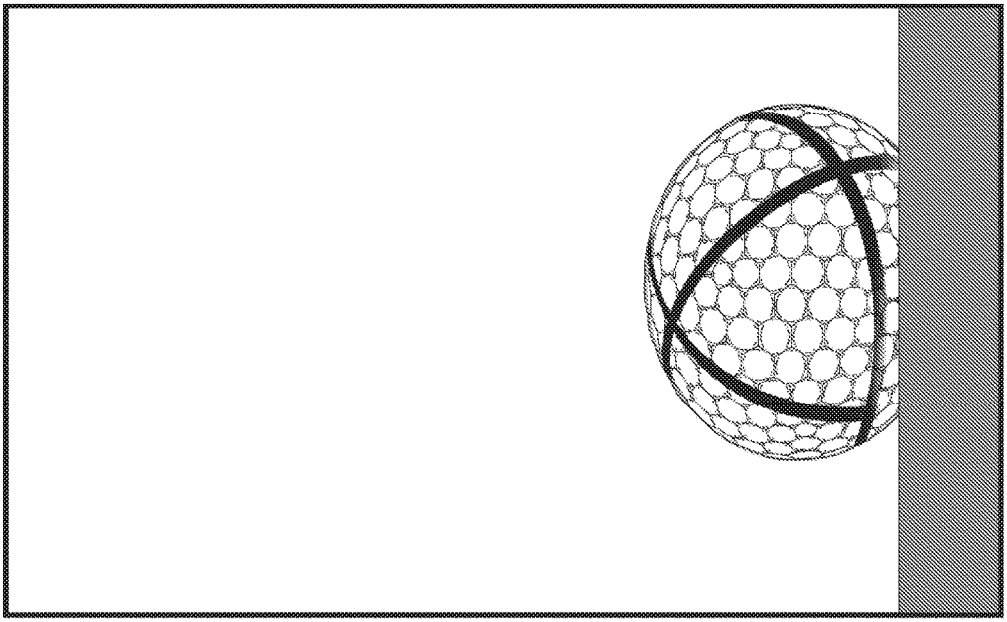
FIG. 6 is an illustration of a sample of a high speed ball impact into COR plate.

As shown in FIG. 6, balls and cores were fired into the plate at incoming speeds targeting 75, 100, 125, and 150 feet per second ("fps").

Figure 8:
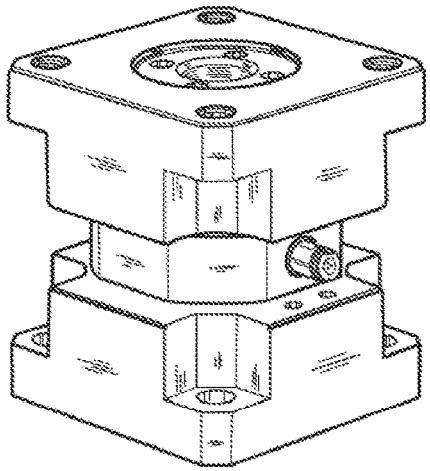
FIG. 8 is an illustration of a Kistler force sensor.
Figure 9:
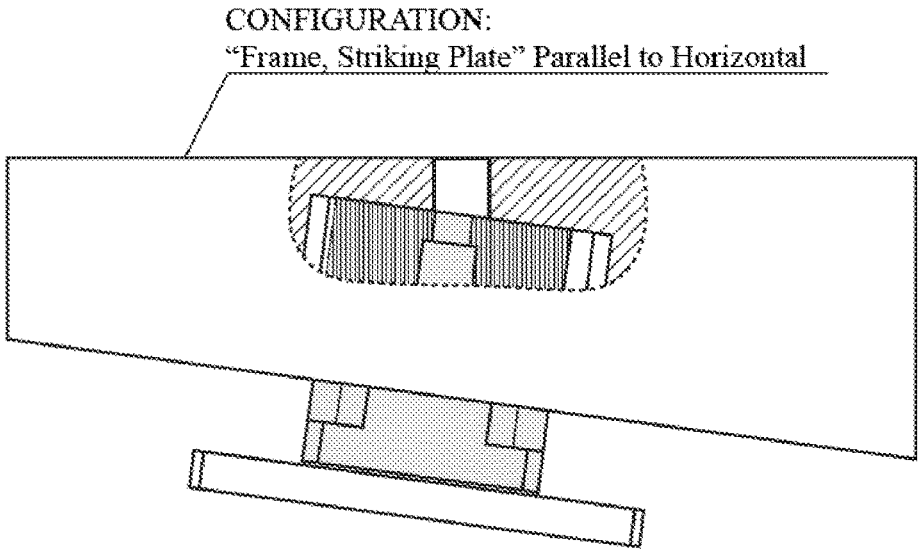
FIG. 9 is an illustration of the force sensor positioned between two steel plates so that a golf ball does not directly contact the force sensor.

As shown in FIGS. 8 and 9, Contact time is measured using a Kistler force sensor (model 9367) fixed to the solid steel plate in a PTM COR machine (built by ADC). Contact Time (150 fps) refers to the duration that the ball or core remained on the surface of the plate when fired at an incoming speed of 150 fps. Similarly, Contact Time (75 fps) refers to the 75 fps incoming speed condition.

Figure 5:
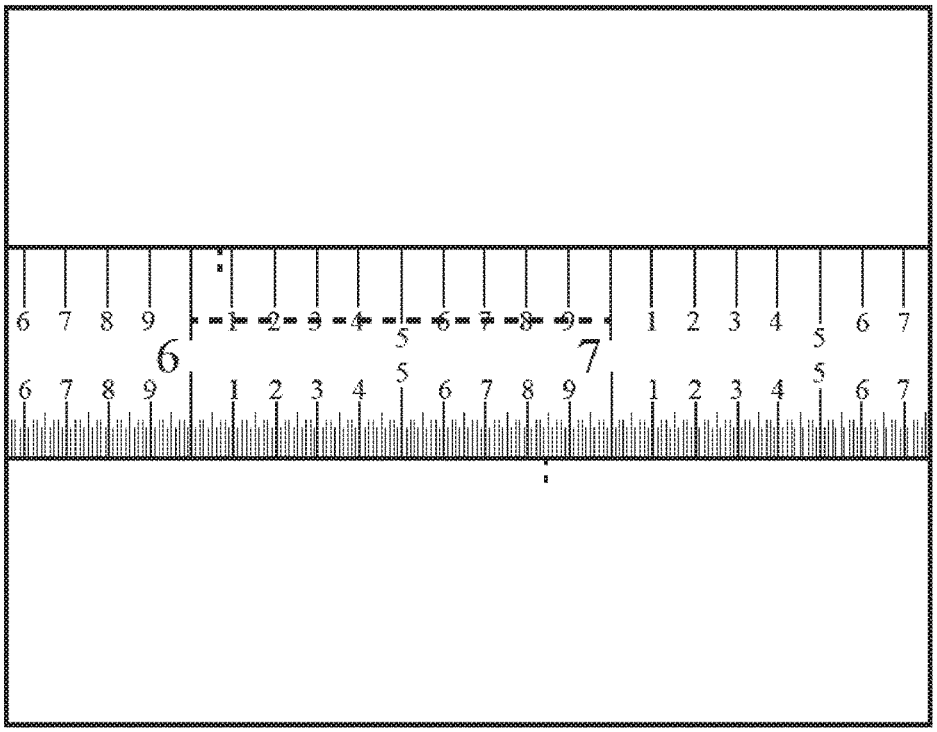
FIG. 5 is an illustration of a measurement software calibration.
Figure 7:
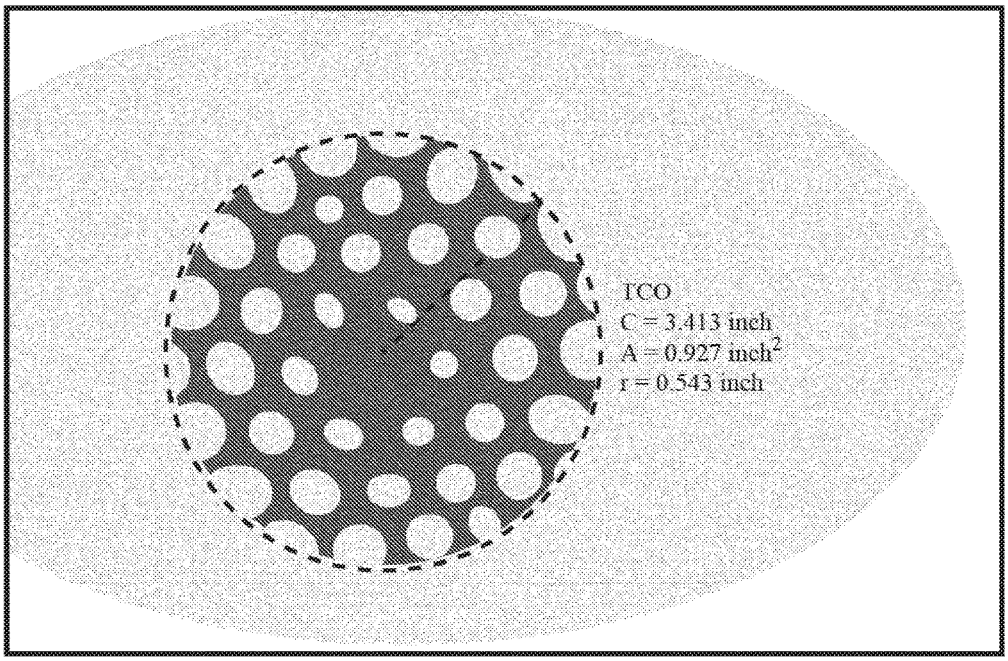
FIG. 7 is an illustration of an impact tape sample measurement with calculated values.

As shown in FIGS. 5 and 7, contact area is determined by placing a piece of impact tape (standard to the golf industry) on the COR plate at the location of impact. After impact, the total area is quantified by removing the piece of tape, placing it under a microscope, and using a simple SW program with measurement tool to fit to the outside of the impact area to get the total area. Contact Area (150 fps) refers to the total area of the impact circle when the ball is fired at an incoming speed of 150 fps. Similarly, Contact Area (75 fps) refers to the 75 fps incoming speed condition.

Using the equations For Aggregate Impact Ratio ($AI_R$), Aggregate Impact Value ($AI_v$), and Relative Impact Rate ($RI_R$) above, we can observe how the ball of this invention (listed as CHROME SOFT PROTO) outperforms the competitive dataset:

$$AI_R=(CT_{150}/CT_{75})\times(CA_{150}/CA_{75})$$

$$AI_V=(\text{Contact Time})\times(\text{Contact Area})$$

$$RI_R=(CA_{150}/CA_{75})\div(CT_{150}/CT_{75})$$

In general terms, the present invention produces a golf ball that does a couple things: For the Core: The deformation occurs in such a way that the impact area increases at a higher rate than the contact time as impact speed is increased. For all conventional cores tested, impact area and contact time increased proportionally as speed increased. This new product, in essence, improves 'perceived feel' by increasing contact area, without sacrificing ball speed, as measured by contact time on the surface. For the Ball: The rate at which the impact area and contact time increase as the impact force increases, causes the ball to perform better at a given feel level.

To further illustrate this point, and to verify that these performance metrics aren't associated with overall ball compression, you can see below that there is no correlation between the $AI_R$ or $RI_R$ and ball or core compression. If these results were strictly a result of softer construction, or softer core compression, the R^ 2 values in these charts would be very close to 1.0.

The golf ball of this design is built with a polybutadiene based core at the center. This core can be single piece or multiple layers. The core is preferably constructed with a high-cis neodymium catalyzed rubber of the 60 Mooney variety. The core preferably incorporates ZDA as its primary cross-linking agent, of the Dymalink tradename, and includes pentachlorothiophenol. This particular construction, labeled M44272 Chrome Soft Proto in the charts, has a core deflection of 0.192 Instron when tested under a 200 lb load. This group has a single 65 shore D ionomer-based mantle layer molded over it and ground to 0.030 inch thickness. The cover is approximately 0.034 inch thick and is comprised of an 88 shore A thermoplastic urethane. The ball diameter is roughly 1.685 inches to conform with the USGA regulations of >1.680 inches.

Although the ball described above is a three-piece urethane cover construction, this invention can apply to two-piece, and multi-layer constructions with other types of cover materials.

Measurements are taken using USB camera (Dino-Lite model AD413T) and measurement software (Dino Capture 2.0 v1.5.10). The measurement software calculates the average of radius, area, and circumference of the shaded area representing the impact of the ball. Calibration of the camera is performed each day measurements are taken by using a standard Shinwa 3102C stainless steel ruler. An example of the image after the calibration is completed is shown in FIG. 5.

Test Procedure: Three impact tape samples are collected from each ball group at each test condition (robot or COR machine); The impact tape sample is centered in camera field of view; Click on Three Points Circle tool; Click three spots at the outer edge of the sample impact imprint roughly 120° from each other; After the third point is clicked, an adjustable circle with radius appears overlaid on image; Drag the mouse to adjust size and center of circle. Idea is to best fit a circle to precisely encompass the impact imprint; A final click of the mouse freezes the size and position of the circle; Radius, area, and circumference are automatically calculated and displayed on image (FIG. 7); These values are recorded in an Excel spreadsheet for further analysis.

The contact time test is performed in the PTM COR machine which has been modified with a Kistler force sensor (P/N 9367)—FIG. 8.

The sensor is sandwiched between two steel plates so that the ball does not directly contact the force sensor—FIG. 9.

Figure 10:
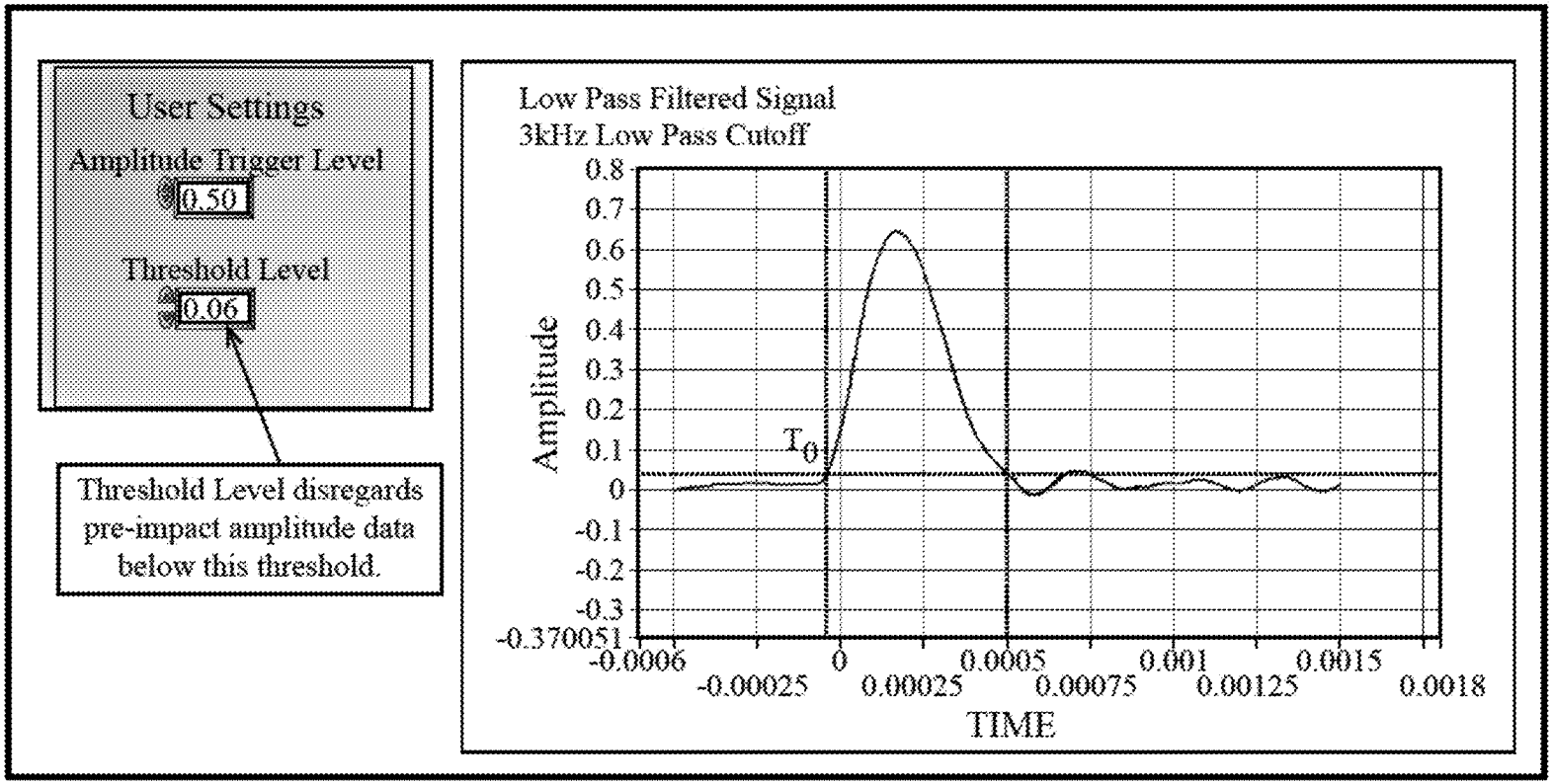
FIG. 10 is an illustration of a user interface for a labview computer program.
Figure 10A:
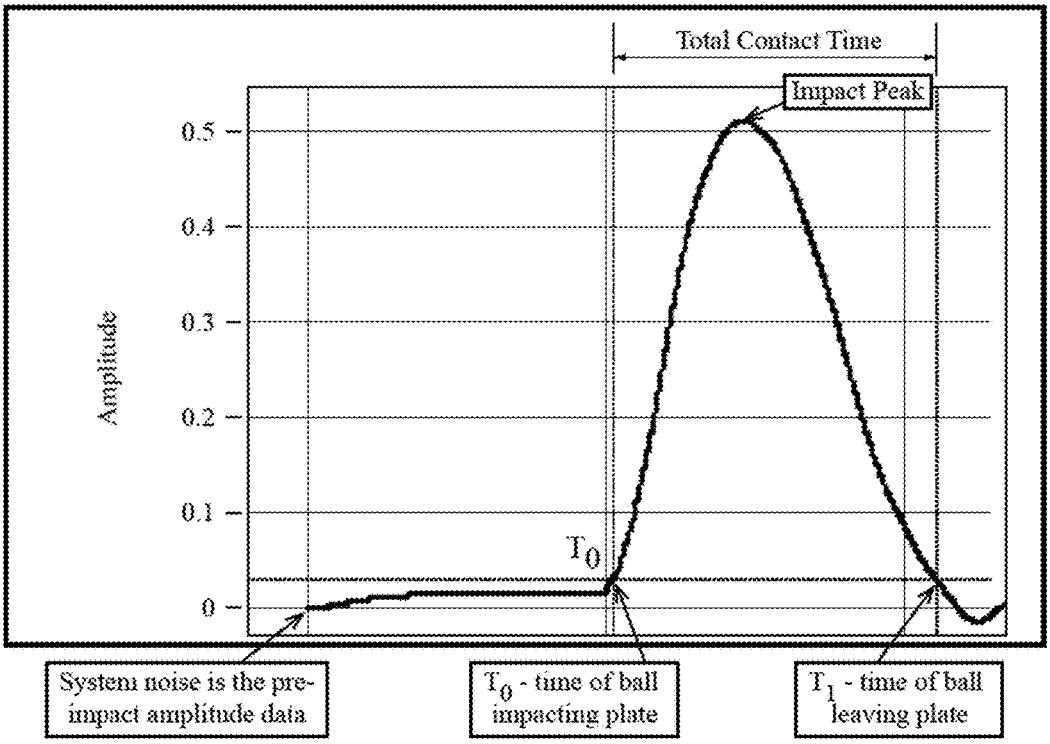
FIG. 10A is an illustration of the graph of FIG. 10 showing amplitude (Y-axis) to time (X-axis).
Figure 11:
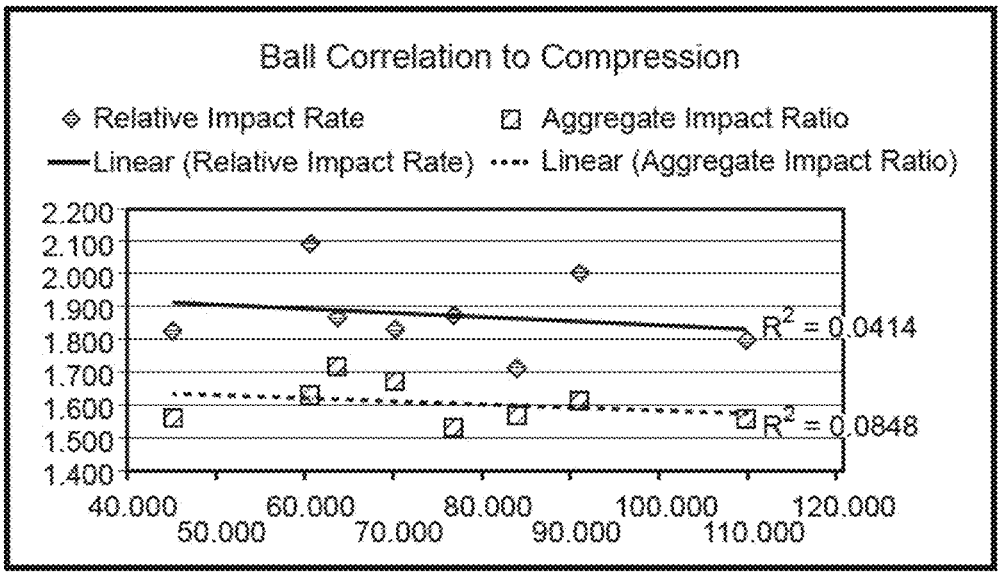
FIG. 11 is a graph of ball correlation (Y-axis) to compression (X-axis).
Figure 12:
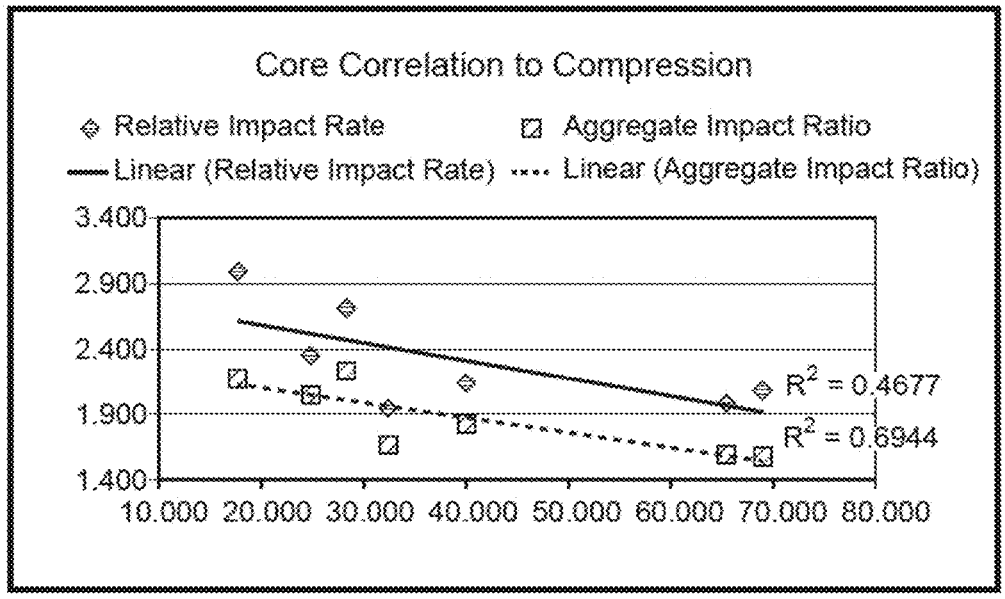
FIG. 12 is a graph core correlation (Y-axis) to compression (X-axis).
Figure 13:
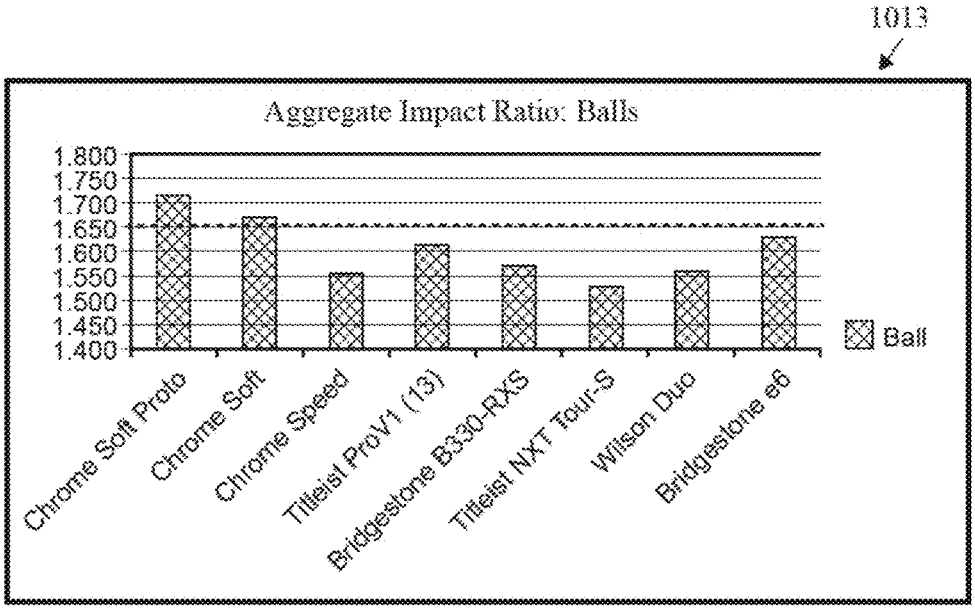
FIG. 13 is a chart of the aggregate impact ratios for golf balls.
Figure 14:
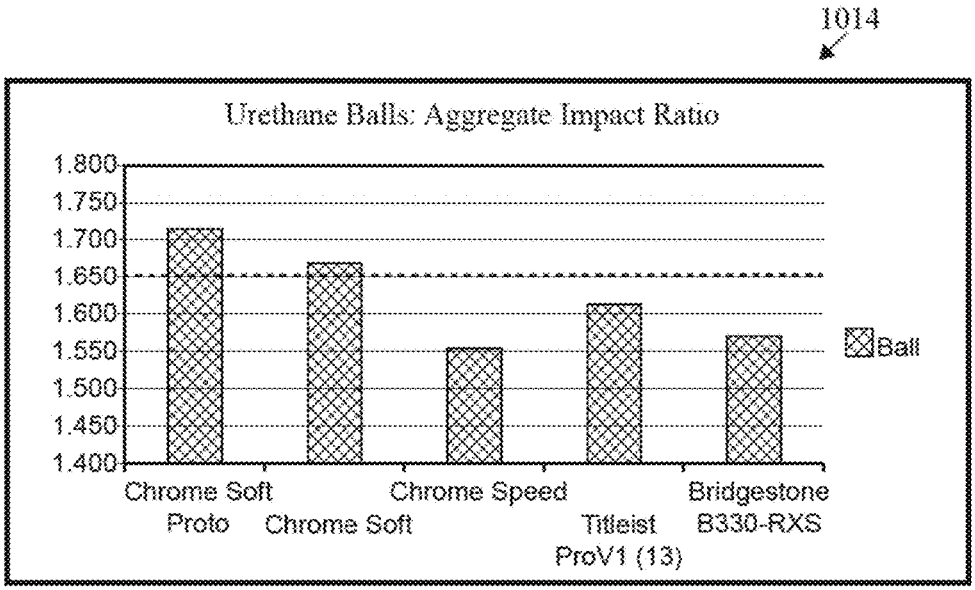
FIG. 14 is a chart of the aggregate impact ratios for golf balls with urethane covers.
Figure 15:
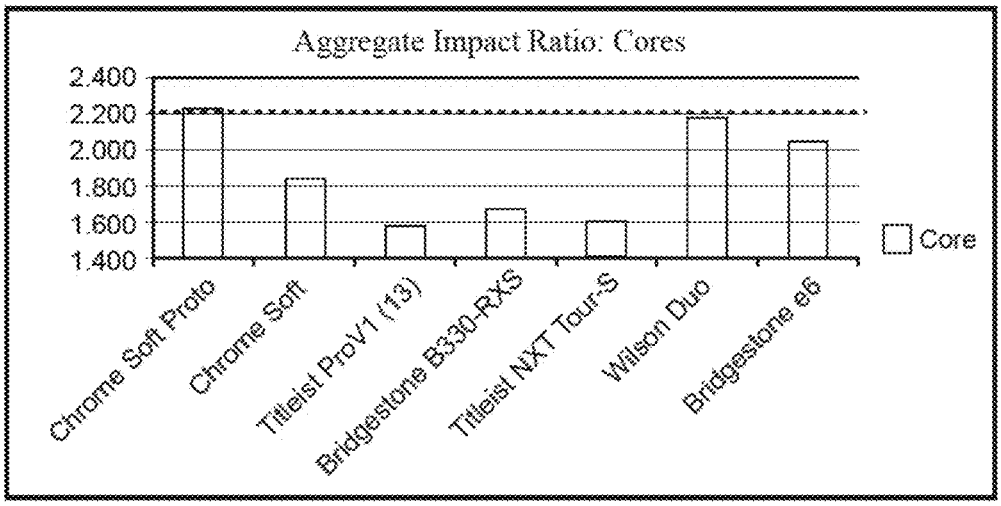
FIG. 15 is a chart of the aggregate impact ratios for the cores of golf balls.
Figure 16:
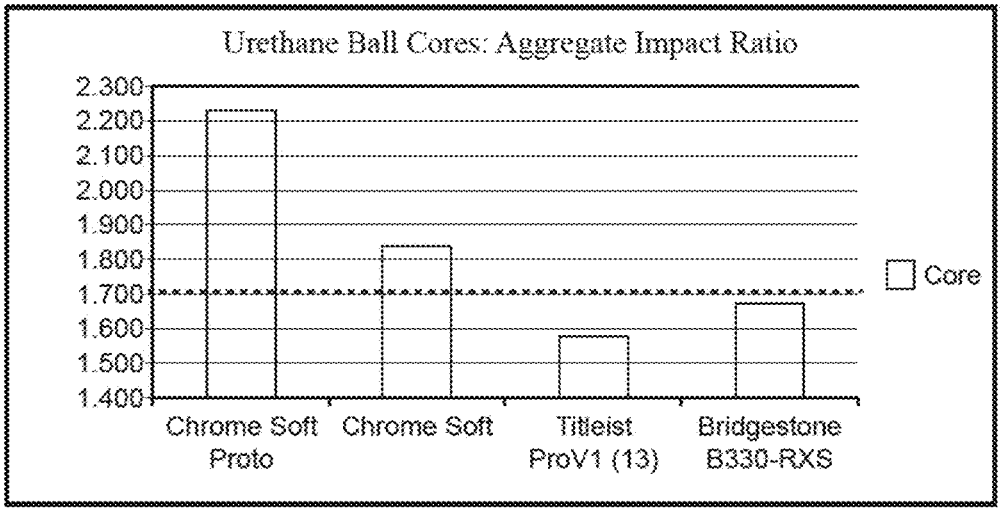
FIG. 16 is a chart of the aggregate impact ratios for the cores of golf balls with urethane covers.
Figure 17:
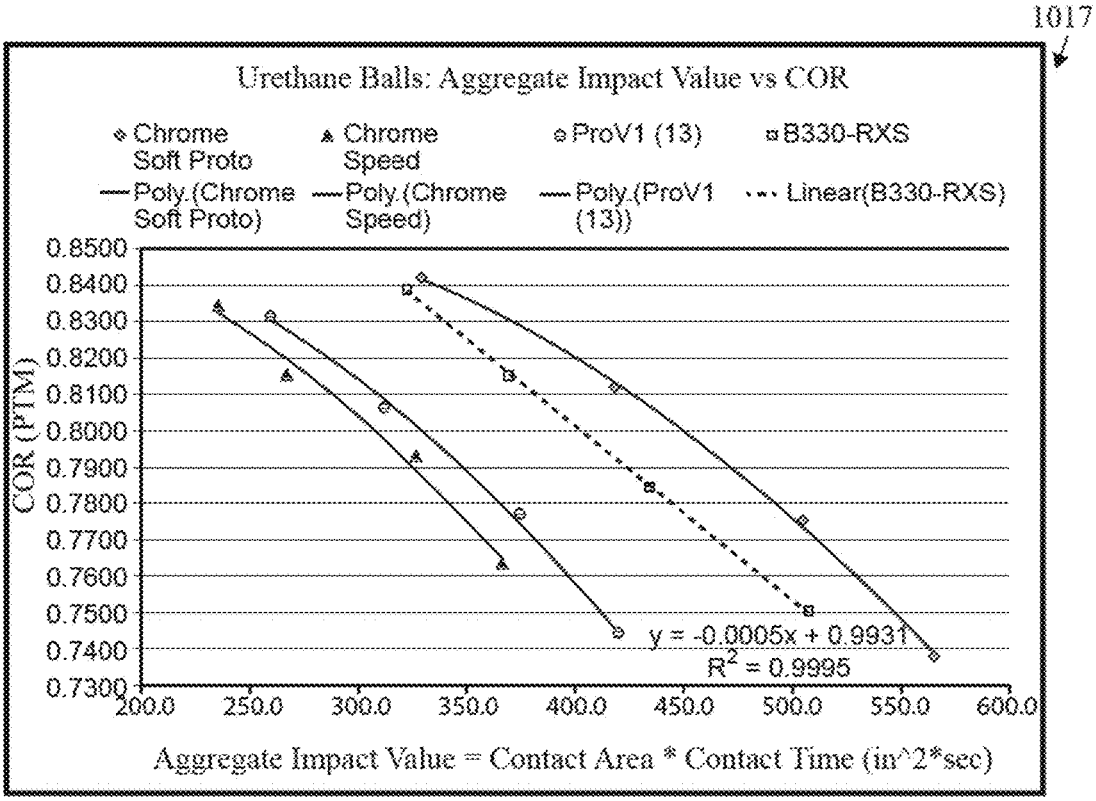
FIG. 17 is a graph of COR (Y-Axis) to aggregate impact values (X-axis).
Figure 18:
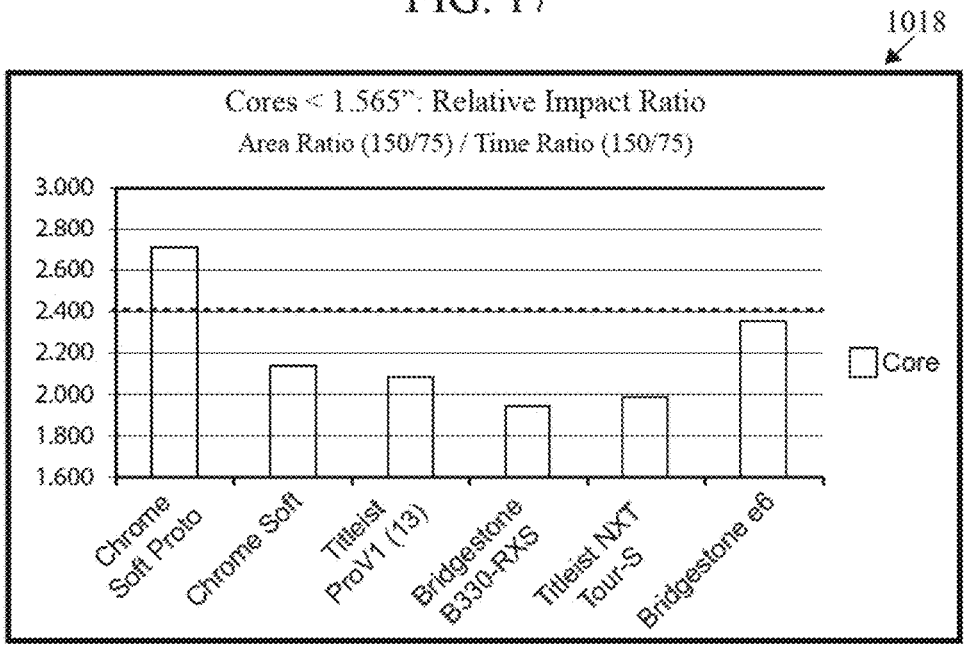
FIG. 18 is a chart of the relative impact ratios for golf balls.

Contact Time Setup: Load the samples through the hole in the Plexiglas in numerical order: Close and secure the door; Press the RESET button located on the front control panel of the PTM to clear any history that may be stored in memory; Set the air pressure; Open Labview program "ImpactTimeV4.0.vi" (FIG. 10); Enter the group number of the samples to be tested and the work order number; Verify that the Amplitude Trigger level is low enough to detect impact of samples; Verify that the trigger threshold level is appropriately above the noise of the sensor signal (pre-impact data); Click the run program button (single arrow) in the upper left corner of the ImpactTimeV4.0.v; Input the number of samples to be tested and number of shots per sample; On the PTM control panel, confirm that the number of balls and shots have been updated accordingly.

Contact Time Test: Press the "START TEST" button; Adjust the air pressure as necessary to hit the target speed; The machine will stop automatically when the test is complete; When test is complete, verify in the ImpactTimeV4.0.vi Labview program that the expected number of shots have been collected; In the Contact Time Excel template, click "Collect Test Data" to transfer data from the PTM machine; Open the PTM and remove the samples from the collection bin.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention the following:

1. A golf ball consisting essentially of:

a multi-layer core having a diameter ranging from 1.50 inches to 1.60 inches, the multi-layer core having a deflection of at least 0.230 inch under a load of 220 pound, the core having a COR of at least 0.780;

a mantle layer disposed over the multi-layer core, the mantle layer composed of a blend of ionomers, the mantle layer having a thickness ranging from 0.025 inch to 0.040 inch; and a cover disposed over the mantle layer, the cover composed of a thermoplastic polyurethane material having a Shore A hardness ranging from 70 to 95, the cover having a thickness ranging from 0.025 inch to 0.040 inch;

wherein the cover has a specific gravity greater than the core;

wherein the golf ball has a PGA compression no greater than 75;

wherein the golf ball has an Aggregate Impact Ratio ($AI_R$) greater than 1.65, wherein $$AI_R=(CT_{150}/CT_{75})\times(CA_{150}/CA_{75})$$

wherein $CT_{150}$ is a golf ball contact time at an impact speed of 150 feet per second, $CT_{75}$ is a golf ball contact time at an impact speed of 75 feet per second, $CA_{150}$ is a golf ball contact area at an impact speed of 150 feet per second, and $CA_{75}$ is a golf ball contact area at an impact speed of 75 feet per second.

2. The golf ball according to claim 1 wherein the mass of the cover is greater than the mass of the mantle layer.

3. The golf ball according to claim 1 wherein the multilayer core further comprises a zinc diacrylate.

4. The golf ball according to claim 1 wherein the mass of the cover is at least 10% of the mass of the golf ball.

5. The golf ball according to claim 1 wherein the multilayer core has a mass ranging from 30 grams to 40 grams.

6. A golf ball comprising:

a core having a diameter ranging from 1.50 inches to 1.60 inches, the core having a plurality of layers, the core having a deflection of at least 0.230 inch under a load of 220 pound, the core having a COR of at least 0.780;

a mantle layer disposed over the core, composed of a blend of ionomers, the mantle layer having a thickness ranging from 0.025 inch to 0.040 inch; and a cover disposed over the mantle layer, the cover composed of a thermoplastic polyurethane material having a Shore A hardness ranging from 70 to 95, the cover having a thickness ranging from 0.025 inch to 0.040 inch;

wherein the cover has a specific gravity greater than the core;

wherein the golf ball has an Aggregate Impact Ratio ($AI_R$) greater than 1.65, wherein $$AI_R=(CT_{150}/CT_{75})\times(CA_{150}/CA_{75})$$

wherein $CT_{150}$ is a golf ball contact time at an impact speed of 150 feet per second, $CT_{75}$ is a golf ball contact time at an impact speed of 75 feet per second, $CA_{150}$ is a golf ball contact area at an impact speed of 150 feet per second, and $CA_{75}$ is a golf ball contact area at an impact speed of 75 feet per second.

7. The golf ball according to claim 6 wherein the mass of the cover is greater than the mass of the mantle layer.

8. The golf ball according to claim 6 wherein the core further comprises a zinc diacrylate.

9. The golf ball according to claim 6 wherein the mass of the cover is at least 10% of the mass of the golf ball.

10. A golf ball comprising:

a core having a diameter ranging less than 1.565 inches, the core having a deflection of at least 0.230 inch under a load of 220 pound, the core having a COR of at least 0.780;

a mantle layer disposed over the core, composed of a blend of ionomers, the mantle layer having a thickness ranging from 0.025 inch to 0.040 inch, the mantle layer having a Shore D hardness of at least 60; and a cover disposed over the mantle layer, the cover composed of a thermoplastic polyurethane material having a Shore A hardness ranging from 70 to 95, the cover having a thickness ranging from 0.025 inch to 0.040 inch;

wherein the cover has a specific gravity greater than the core;

wherein the golf ball has a diameter of at least 1.68 inches;

wherein the golf ball has a PGA compression no greater than 75;

wherein the core of the golf ball has an Relative Impact Ratio ($RI_R$) greater than 2.40, wherein $$RI_R=(CA_{150}/CA_{75})\times(CT_{150}/CT_{75})$$

wherein $CT_{150}$ is a core contact time at an impact speed of 150 feet per second, $CT_{75}$ is a core contact time at an impact speed of 75 feet per second, $CA_{150}$ is a core contact area at an impact speed of 150 feet per second, and $CA_{75}$ is a core contact area at an impact speed of 75 feet per second.

* * * * *